US011165226B2

(12) United States Patent
Herzberg et al.

(10) Patent No.: US 11,165,226 B2
(45) Date of Patent: Nov. 2, 2021

(54) SPARK PLUG INCLUDING A MULTI-STEP INSULATOR SEAT

(71) Applicant: Robert Bosch GmbH, Stuttgart (DE)

(72) Inventors: Matthias Herzberg, Schwieberdingen (DE); Chris Schimmel, Waiblingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/622,592

(22) PCT Filed: Apr. 11, 2018

(86) PCT No.: PCT/EP2018/059262
§ 371 (c)(1),
(2) Date: Dec. 13, 2019

(87) PCT Pub. No.: WO2018/233890
PCT Pub. Date: Dec. 27, 2018

(65) Prior Publication Data

US 2021/0151958 A1 May 20, 2021

(30) Foreign Application Priority Data

Jun. 20, 2017 (DE) ..... 102017210235.7

(51) Int. Cl.
*H01T 13/36* (2006.01)

(52) U.S. Cl.
CPC ..... *H01T 13/36* (2013.01)

(58) Field of Classification Search
None
See application file for complete search history.

(56) References Cited

U.S. PATENT DOCUMENTS

| | | | |
|---|---|---|---|
| 2,250,355 | A | 7/1941 | Bruck |
| 2013/0147339 | A1 | 6/2013 | Burrows |

FOREIGN PATENT DOCUMENTS

| | | | |
|---|---|---|---|
| DE | 10344186 | | 4/2005 |
| DE | 102015200407 | A1 | 7/2016 |
| DE | 102016200430 | A1 | 7/2017 |
| EP | 2479855 | A1 | 7/2012 |
| EP | 2713458 | A2 | 4/2014 |
| JP | S6139880 | U | 3/1986 |
| JP | 2017004933 | A | 1/2017 |
| RU | 2055432 | C1 | 2/1996 |

(Continued)

OTHER PUBLICATIONS

International Search Report for PCT/EP2018/059262, dated Jul. 5, 2018.

*Primary Examiner* — Vip Patel
(74) *Attorney, Agent, or Firm* — Norton Rose Fulbright US LLP; Gerard Messina

(57) ABSTRACT

A spark plug is provided, including a housing, an insulator situated within a housing, the insulator having a longitudinal axis, an insulator foot, body, head, and seat. Inside the housing is a housing seat which is in contact with the insulator seat of the insulator. An inner seal is situated between the housing seat and the insulator seat, so that the inner seal, the housing seat, and the insulator seat form a sealing system. The insulator seat includes a step that has a first section and a second section having an angle γ to one another that is greater than 0° and the first section being parallel to the insulator longitudinal axis. The inner seal is in contact with this first section, so that a radial sealing surface is formed at the insulator.

32 Claims, 4 Drawing Sheets

(56) References Cited

FOREIGN PATENT DOCUMENTS

| | | | |
|---|---|---|---|
| RU | 2295812 | C1 | 3/2007 |
| WO | 2016113144 | | 7/2016 |
| WO | 2017121524 | | 7/2017 |

SPARK PLUG INCLUDING A MULTI-STEP INSULATOR SEAT

FIELD

The present invention is directed to a spark plug.

BACKGROUND INFORMATION

A spark plug is described in German Patent Application No. DE 103 44 186 A1, for example.

A properly functioning spark plug and its components have always had to have been able to fulfill a series of requirements, such as longevity, reliable ignition properties, dielectric strength, and gas-tightness. The conditions, such as the temperature and pressure in the combustion chamber, on which the spark plug must function reliably and preferably for a long time, were and are becoming more and more extreme. The temperature and pressure conditions prevailing in the combustion chamber during the operation of the engine in particular put the gas-tightness of the installed spark plug to the test.

Today's spark plugs have a series of sealing elements and sealing materials to achieve and ensure the required gas-tightness. One approach for sealing the gap between the insulator and the housing is illustrated in FIG. 2. On its inside, the housing has a tapering of the inner diameter in the direction of the combustion-chamber side housing end. This tapering is also referred to as housing seat. The area of the housing seat is inclined at an angle $\alpha$ with regard to the housing longitudinal axis or the spark plug longitudinal axis, which typically coincides with the housing longitudinal axis. $\alpha$ is typically in the range of 55° to 65°. The insulator also has a tapering of an outer diameter in the direction of its combustion-chamber side end or its insulator foot. This tapering is referred to as an insulator seat or also as a foot fillet. The surface of the insulator seat is inclined with regard to the insulator longitudinal axis or the spark plug longitudinal axis, which typically coincides with the insulator longitudinal axis. The housing seat and the insulator seat often have different inclinations with regard to the spark plug longitudinal axis. The insulator seat is supported by the housing seat, an inner seal, often in the form of a sealing disk or a sealing ring, being situated between the two seat areas. By pressing the housing and the insulator into one another, the inner seal is deformed and an axial sealing surface is formed together with the housing seat and the insulator seat in each case. The axial sealing surface typically has a size of approximately 10 $mm^2$ in the case of a M12 spark plug. This sealing concept has proven its worth in the combustion chamber for temperatures up to approximately 220° C. and pressures up to approximately 22 bar.

However, the requirements on the performance of engines and thus also on the spark plugs are increasing. Particularly in the field of downsizing engines, higher and higher pressures and temperatures are employed, thus subjecting the spark plug to new stresses. Temperatures of up to 300° C. and pressures up to 30 bar are increasingly the norm and no longer the exception during the operation of an internal combustion engine.

In the case of the outer sealing, there is room for maneuver to a certain degree to achieve a gas-tight transition between the spark plug and the cylinder head through the clamping torque, at which the spark plug is screwed in into the cylinder head. Today, a M12 spark plug is tightened at a clamping torque of up to 60 Nm, for example, while in the past, a clamping torque of 40 Nm was sufficient.

SUMMARY

It has proven, however, that the sealing concept used thus far for the inner seal, the gap between the housing and the insulator, is increasingly reaching its limitations with regard to the increasing requirements and forces acting on the spark plug. The higher clamping torque in particular results in the housing being elongated during the installation in the area of the thread. In the area of the thread, the housing seat is located on the inside of the housing. As a result of the elongation of the housing, the pretensioning force, at which the housing and the insulator are pressed into one another, is reduced, whereby the inner seal is no longer pressed strongly enough between the housing and the insulator, whereby the pressing of the surfaces between the inner seal and the insulator or the housing and thus also the sealing surface are reduced and the sealing surface is no longer able to sufficiently offer resistance to the considerable pressures prevailing in the combustion chamber so that the spark plug is sufficiently gas-tight.

Accordingly, it is an object of the present invention to improve a spark plug of the type mentioned at the outset to the extent that the spark plug and in particular the gap between the insulator and the housing are reliably gas-tight even in the case of increasing temperatures and pressures in the combustion chamber. For this purpose, a new inner seal concept or inner seal system is necessary.

According to the present invention, this object is achieved in the case of the spark plug of the type mentioned at the outset in that the insulator seat includes at least one step that has a first section and at last one second section, the first section and the second sections having an angle $\gamma$ to one another that is greater than 0° and the first section being parallel to the insulator longitudinal axis, the inner seal being in contact with this first section, so that a radial sealing surface is formed at the insulator.

The spark plug according to the present invention includes a housing, an insulator situated within the housing, a center electrode situated within the insulator, a ground electrode situated at a front side of the housing facing the combustion chamber, the ground electrode and the center electrode being situated in such a way that the two electrodes form an ignition gap.

The insulator has a longitudinal axis X along its longitudinal extension. This longitudinal axis may also be a mirror axis and/or a rotation axis for the insulator, when the insulator is viewed in a section along the longitudinal axis, for example. Insulator longitudinal axis X typically coincides with the spark plug longitudinal axis and a housing longitudinal axis in the case of the installed spark plug. The insulator may be divided into three areas along its longitudinal axis: insulator foot, insulator body, and insulator head. The area forming the combustion-chamber side end of the insulator is referred to as the insulator foot. The insulator head forms the end of the insulator facing away from the combustion chamber. The insulator body is situated between the insulator head and the insulator foot. The three areas often have different outer diameters, the outer diameter within an area also possibly varying. The transitions between the areas are designed as shoulders or fillets. The transition between the insulator body and the insulator foot is also referred to as a foot fillet or an insulator seat.

On its inside, the housing furthermore includes a housing seat, on which the insulator seat of the insulator is supported, an inner seal being situated between the housing seat and the insulator seat, so that the inner seal, the housing seat, and the insulator seat form a sealing system.

According to the present invention, it is provided that the insulator seat includes at least one step that has a first section and at last one second section, the first section and the second sections having an angle γ to one another that is greater than 0° and the first section being parallel to insulator longitudinal axis X, the inner seal being in contact with this first section, so that a radial sealing surface is formed at the insulator. More precisely, the radial sealing surface is formed between the first section of the step in the insulator seat and the inner seal.

By designing a radial sealing surface, the advantage results that the spark plug remains perfectly gas-tight despite the pretensioning force between the housing and the insulator being reduced due to the elongation of the housing in the process of the spark plug being screwed in into a cylinder head. The pretensioning force is a force that has a great axial force component and a smaller radial force component. This results in that the radial sealing surface, which is primarily caused by the radially acting forces between the inner seal and the insulator, is hardly affected by the housing elongation and the reduction, in particular of the axial component, of the pretensioning force connected thereto. Another advantage is yielded in the operation of the spark plug. As a result of the higher temperatures during the operation of the spark plug, the material of the inner seal as well as the other components of the spark plug expand. Studies by the applicant have shown that the inner seal has a greater heat expansion in the axial direction than in the radial direction; this means that the rising temperature during the operation of the spark plug or of the engine changes the force ratio acting in the axial direction, thus reducing the tightness at the axial sealing surfaces. In contrast, the force ratio acting in the radial direction remains relatively unaffected by the heat expansion of the inner seal and thus also the tightness at the radial sealing surfaces.

In the sense of this application, axial force or axial component means the forces that act in parallel to the longitudinal axis of the spark plug. Correspondingly, radial force or radial component means the forces that act perpendicular to the longitudinal axis of the spark plug. The acting forces may each be divided into an axial and a radial force component.

Within the scope of the present description, the word "parallel" is not used in the narrow geometric literal sense. "Parallel," in particular in connection with the orientation of areas, is also contemplated for small deviations from a strictly geometric parallelism as a parallel orientation that is brought about by manufacture-related uncertainties, for example. For example, an area or a section is contemplated as being parallel or essentially parallel to the insulator longitudinal axis if it maximally has an angle of 10° with regard to the insulator longitudinal axis.

In this application, every sealing surface that is in contact with an area or a section being essentially parallel to the insulator longitudinal axis, the housing longitudinal axis, or the spark plug longitudinal axis is contemplated as a radial sealing surface. Correspondingly, all other sealing surfaces that are in contact with an area or a section being oriented perpendicular to or at an angle to the insulator longitudinal axis, the housing longitudinal axis, or the spark plug longitudinal axis are axial sealing surfaces.

Further advantageous embodiments of the present invention are described herein.

In one advantageous refinement of the spark plug in accordance with the present invention, it is provided that the step at the insulator seat next to the radial sealing surface additionally has at least one axial sealing surface, in particular one that is designed at the at least one second section of the step. In this way, the overall sealing surface is enlarged, thus resulting in an improved overall tightness of the inner seal system. Additionally, the effect results that the axial sealing surface, which is effected primarily by the axial forces acting on the insulator, the inner seal, and the housing, and the radial sealing surface, which is effected primarily by the forces acting radially on the insulator, the inner seal, and the housing, are effected by different components of the pretensioning force, whereby a sealing surface may maintain its functionality, when the functionality is reduced in the other sealing surface due to a decrease in the corresponding force component, for example.

Overall, it has proven advantageous that the step has a first section and two second sections, the first section being situated between the two second sections. Together with the inner seal, a radial sealing surface results, which is situated between two axial sealing surfaces. This yields the advantage that the inner seal is in contact with the entire surface of the first section of the step at the insulator seat and thus forms the greatest possible radial sealing surface at this first section. Furthermore, by combining the axial and the radial sealing surfaces, the overall sealing surface is enlarged and by positioning the first and the second sections of the step at an angle on the insulator seat, the path that the gas must cover for a leak is extended, thus improving the gas-tightness in the inner seal system overall.

In one advantageous specific embodiment, it is provided that the insulator seat includes multiple steps, each of which has a first section and which, together with the inner seal, form multiple radial sealing surfaces. In this way, the above-described technical effects and advantages are particularly effective. In particular also then, when the multiple radial sealing surfaces are connected via axial sealing surfaces in each case, as is the case in one refinement of this specific embodiment.

In specific embodiments including multiple radial sealing surfaces at the insulator seat, there is one radial main sealing surface having at least one radial ancillary sealing surface. Additionally or alternatively, in the case of multiple axial sealing surfaces, there is correspondingly one axial main sealing surface having at least one axial ancillary sealing surface at the insulator seat. In this case, the main sealing surface and the ancillary sealing surface are differentiated by the size of their sealing surface. There is typically a radial or an axial main sealing surface and multiple ancillary sealing surfaces, the main sealing surface having the greatest sealing surface between the insulator and the inner seal. A radial main sealing surface has the greatest length as compared to the other radial sealing surfaces, measured along the longitudinal axis of the insulator. This correspondingly applies to the axial sealing surfaces, the length being measured perpendicular to or at an angle to the insulator longitudinal axis in this case.

A radial main sealing surface is advantageously enclosed by radial ancillary sealing surfaces along the insulator longitudinal axis, the radial sealing surfaces being connected via axial sealing surfaces. An axial main sealing surface may be situated directly at the radial main sealing surface.

A radial ancillary sealing surface may also be designed at the insulator foot and/or at the insulator body, for example, i.e., the inner seal protrudes over the insulator seat after the deformation. This yields the advantage that the entire area of the insulator seat is utilized as a sealing surface, the sealing surface being composed of sections from radial and axial sealing surfaces. The staggered arrangement of the sealing surfaces results in that the leakage path for the gas is particularly long, whereby the spark plug maintains its gas-tightness even in the case of high gas pressures.

The exact shape of the inner seal after the installation of the spark plug and the elastically plastic deformation of the inner seal and the concrete design connected thereto, such as the number and arrangement, of the axial and radial sealing surfaces (number, arrangement) depends on different factors, such as the gap measures between the insulator and the housing upstream and downstream from the insulator seat, the number of steps in the insulator seat, the pretensioning force, at which the insulator is pressed into the housing, or the area of the sealing contour. A corresponding design of these factors also results in the possibility of adapting the inner seal system to particular stresses and requirements in order to optimize the spark plug for the particular use.

Studies of the applicant have shown that it is advantageous if the second sections of a step at the insulator seat have an angle γ of at least 90° to the insulator longitudinal axis (X). Further studies have shown that the above-described technical effects are reproducible up to an angle γ of 175°. These studies have also resulted in the finding that in the case of multiple second sections of one step or in the case of multiple steps, the second sections may all have same angle γ or different angles γ to insulator longitudinal axis X. If all second sections are inclined by the same angle γ to the insulator longitudinal axis, the manufacture is simplified and the manufacturing costs are thus also reduced. If the second sections have different angles γ to the insulator longitudinal axis, this opens the possibility of potentially responding to particularities at the housing seat or the like, as far as the exact design of the spark plug is concerned, and of correspondingly adapting the steps at the insulator seat to the special situation in order to achieve an optimal gas-tightness of the spark plug.

Further studies have additionally shown that the housing seat may span an angle ß that may assume a value from a considerably larger value range than in the case of the inner seal concepts according to the related art, in which α=55°-65° is typical, with regard to insulator longitudinal axis X. Angle ß is the angle within the housing wall. For angle α from the related art, an angle $ß_{SdT}$ of 115° to 125° correspondingly results. In the case of the spark plug according to the present invention, the inner seal system according to the present invention already works if ß has a value of at least 80°, and even works for values of ß up to maximally 170°. Preferably, the value for ß is at least 90° and maximally 160°. In other words, the value range, from which ß may be selected in the inner seal system according to the present invention, has a width of at least 70° starting at an angle ß=90°, preferably at least 90° starting at an angle ß=80°, while in the case of a sealing seat according to the related art, the value range for $ß_{SdT}$ typically only has a width of 10°.

In another advantageous embodiment of the present invention, the inner seal has on average a height h, measured in parallel to insulator longitudinal axis X, and a width d, measured perpendicular to insulator longitudinal axis X, prior to the installation. It has proven advantageous that the ratio of width d to height h of the inner seal is at least 0.5, in particular at least 0.75. The inner seal is preferably a solid body, such as a sealing ring or a sealing disk, i.e., the inner seal is not a powder pack pressed into shape.

The width of the inner seal is advantageously greater than the depth of the housing seat. Depth $a_g$ of the housing seat results as half the difference between inner diameter $c_g$ of the housing upstream from the housing seat, or in the direction of the side of the housing facing away from the combustion chamber, and inner diameter $b_g$ of the housing downstream from the housing seat, i.e., in the direction of the end of the housing on the combustion-chamber side. Depth $a_i$ of the insulator seat is similarly defined as a half difference between outer diameter $c_i$ of the insulator upstream from the insulator seat, i.e., at the insulator body, and outer diameter $b_i$ of the insulator downstream from the insulator seat, i.e., at the insulator foot. For example, depth of the insulator seat $a_i$ is less than or equal to depth of the housing seat $a_g$.

It is additionally advantageous, when the radial sealing surface at the insulator seat has a height, measured in parallel to insulator longitudinal axis X, of at least 30%, in particular at least 36%, of height h of the inner seal.

In the case of multiple radial sealing surfaces at the insulator seat, the radial main sealing surface at the insulator seat alternatively has a height, measured in parallel to insulator longitudinal axis X, of at least 30%, in particular at least 36%, of height h of the inner seal. It is additionally conceivable that the radial ancillary sealing surfaces at the insulator seat have a height, measured in parallel to insulator longitudinal axis X, of at least 1%, in particular at least 5%, of height h of the inner seal.

It has proven advantageous for the axial sealing surface, when same has a width at the insulator seat, measured perpendicular to insulator longitudinal axis X, of at least 15%, in particular at least 20%, of width d of the inner seal. In the case of multiple axial sealing surfaces, the axial main sealing surface may have a width at the insulator seat, measured perpendicular to insulator longitudinal axis X, of at least 15%, in particular at least 20%, of width d of the inner seal. Additionally or alternatively, the axial ancillary sealing surfaces may have a width at the insulator seat, measured perpendicular to insulator longitudinal axis X, of at least 1%, in particular at least 5%, of width d of the inner seal.

It is possible in principle that the inner seal and the housing form an axial sealing surface at the housing seat and a radial sealing surface on the inside of the housing. It has proven advantageous that the radial sealing surface at the housing has a height, measured in parallel to insulator longitudinal axis X, of at least 30%, in particular at least 36%, of height h of the inner seal.

In one advantageous refinement of the present invention, the axial (ancillary) sealing surface at the insulator seat, which is directly adjoining the insulator foot, has at least a width that corresponds to the, in particular narrowest, gap width between the insulator foot and the inside of the housing opposing the insulator foot and directly at the insulator seat. It is additionally advantageous, when the width of the axial (ancillary) sealing surface adjoining the insulator foot also corresponds at least to the gap width between the insulator body and the opposing inside of the housing, if this gap has a greater width than the gap between the insulator foot and the inside of the housing.

DETAILED DESCRIPTION OF EXAMPLE EMBODIMENTS

Figure 1:
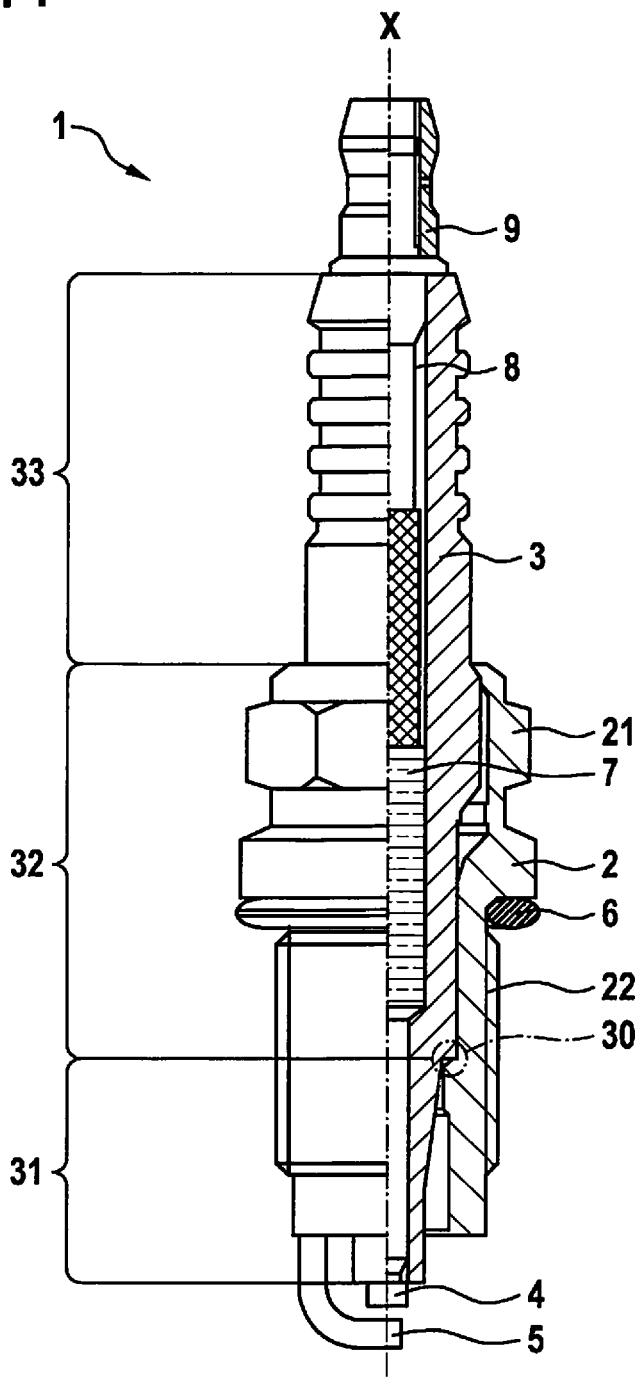
FIG. 1 shows one example of a spark plug.

FIG. 1 shows a spark plug 1 in a half-sectional view. Spark plug 1 includes a housing 2. An insulator 3 is inserted into housing 2. Housing 2 and insulator 3 each have a bore along their longitudinal axes. The longitudinal axis of housing 2, longitudinal axis X of insulator 3, and the longitudinal axis of spark plug 1 coincide. A center electrode 4 is inserted into insulator 3. A connecting bolt 8 furthermore extends into insulator 3. A connecting nut 9, via which spark plug 1 is electrically contactable to a voltage source, is situated at connecting bolt 8. Connecting nut 9 forms the end of spark plug 1 facing away from the combustion chamber.

A resistor element 7, also referred to as a Panat, is located in insulator 3 between center electrode 4 and connecting bolt 8. Resistor element 7 electrically conductively connects center electrode 4 to connecting bolt 8. Resistor element 7 is built as a layer system from a first contact Panat, a resistor Panat, and a second contact Panat, for example. The layers of the resistor element differ in their material composition and the electrical resistance resulting therefrom. The first contact Panat and the second contact Panat may have a different or an identical electrical resistance.

On the front side of housing 2 facing the combustion chamber, a ground electrode 5 is electrically conductively situated. An ignition spark is generated between ground electrode 5 and center electrode 4.

Housing 2 has a shaft. A polygon 21, a shrinkage groove, and a thread 22 are designed at this shaft. Thread 22 is used to screw spark plug 1 into an internal combustion engine. An outer sealing element 6 is situated between thread 22 and polygon 21. Outer sealing element 6 is designed as a folding seal in this exemplary embodiment.

Insulator 3 is typically divided into three areas: insulator foot 31, insulator body 32, and insulator head 33. The three areas are differentiated, for example, by different diameters. Insulator foot 31 is the end of insulator 3 facing the combustion chamber. Center electrode 4 is situated within insulator foot 31. In general, insulator foot 31 is situated completely or at least over the large part of its length, measured in parallel to the spark plug longitudinal axis or insulator longitudinal axis X, within housing 2. Insulator foot 31 generally has the smallest outer diameter at insulator 3.

Insulator body 32, which is generally completely encompassed by housing 2, is situated in an adjoining manner at insulator foot 31. Insulator body 32 has a larger outer diameter than insulator foot 31. The transition between insulator foot 31 and insulator body 32 is designed as a shoulder or a fillet. This transition is also referred to as a foot fillet or an insulator seat 35.

Insulator head 33 adjoins the end of insulator body 32 facing away from the combustion chamber and forms the end of insulator 3 facing away from the combustion chamber. Insulator head 33 protrudes from housing 2. The outer diameter of insulator head 33 is between the outer diameter of insulator foot 31 and insulator body 32, the areas typically not having constant outer diameters over their lengths, but potentially varying outer diameters.

Housing 2 has a seat 25 at its inside. The shoulder or insulator seat 35 of the insulator is in contact with housing seat 25. An inner seal 10 is situated between insulator seat 35 and housing seat 25. Area 30 of housing seat 25 and of insulator seat 35 is indicated by a circle in FIG. 1 and described in greater detail in subsequent FIGS. 2 through 6.

Figure 2:
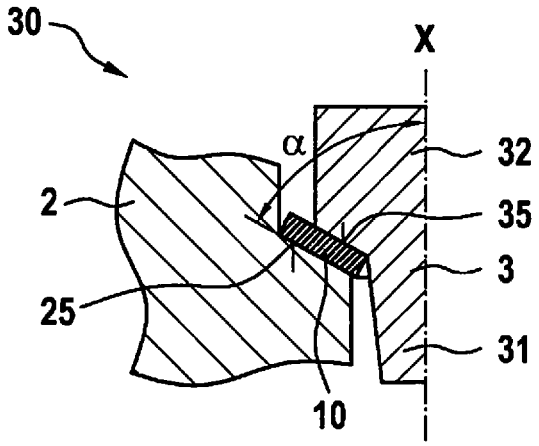
FIG. 2 shows in detail the arrangement of the housing seat, the insulator seat, and the inner seal of a spark plug according to the related art.

FIG. 2 shows in detail area 30 including housing seat 25, insulator seat 35, and inner seal 10 according to the related art. Housing seat 25 has an inclination of $\alpha$=55°-65° with regard to the spark plug longitudinal axis. The area of insulator seat 35 results from the transition of insulator foot 31 to insulator body 32, in which the outer diameter continuously increases. This arrangement results in an axial sealing surface between housing seat 25, insulator seat 35, and inner seal of approximately 10 $mm^2$, the pretensioning force, with the aid of which housing 2 and insulator 3 are pressed into each other, being at 1.5 kN up to 10 kN.

Figure 3:
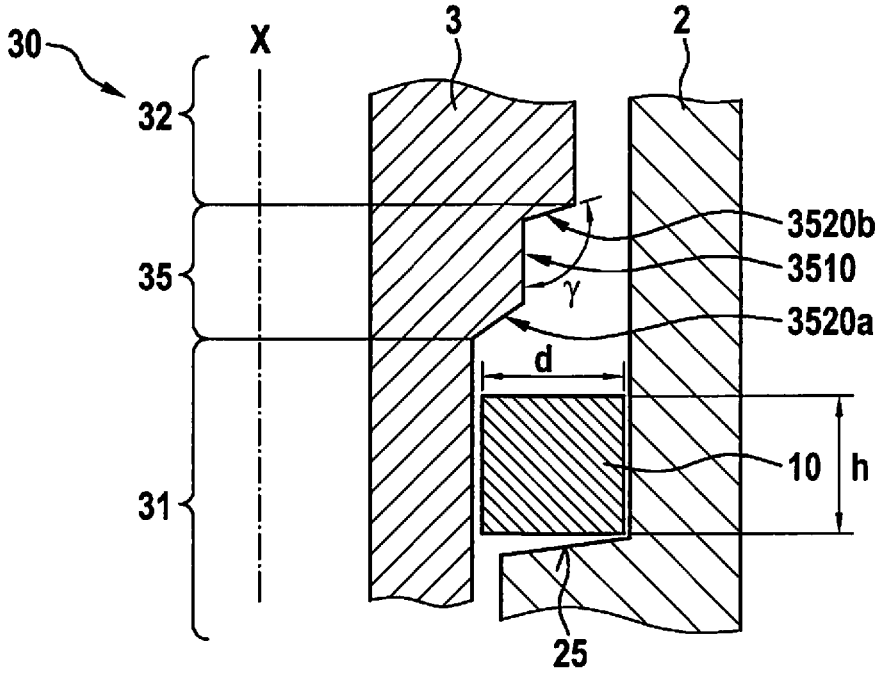
FIG. 3 shows in detail the insulator seat including a step, the inner seal, and the housing seat of the spark plug according to an example embodiment of the present invention prior to the installation.

FIG. 3 shows in detail area 30 including housing seat 25, insulator seat 35, and inner seal 10 prior to the installation of insulator 3 into housing 2 according to the present invention. Inner seal 10 is in contact with housing seat 25. Prior to the installation of insulator 3, the inner seal has a height h, measured in parallel to the longitudinal axis of the spark plugs or insulator longitudinal axis X, and a width d, measured perpendicular to the longitudinal axis of the spark plugs or insulator longitudinal axis X.

Insulator seat 35, which forms the transition between insulator foot 31 and insulator body 32, has one step in this example. The step may be divided into three sections. A first section 3510 has a surface that is parallel to insulator longitudinal axis X and thus this first section 3510 is also parallel to insulator longitudinal axis X. The two other sections 3520, also referred to as the second section, are inclined by an angle $\gamma$ with regard to first section 3510. Here, every second section 3520 has a different angle $\gamma$ with regard to first section 3510 or to insulator longitudinal axis X, for example. Alternatively, different second sections 3520 may have same angle $\gamma$ with regard to first section 3510 or to insulator longitudinal axis X.

Figure 4:
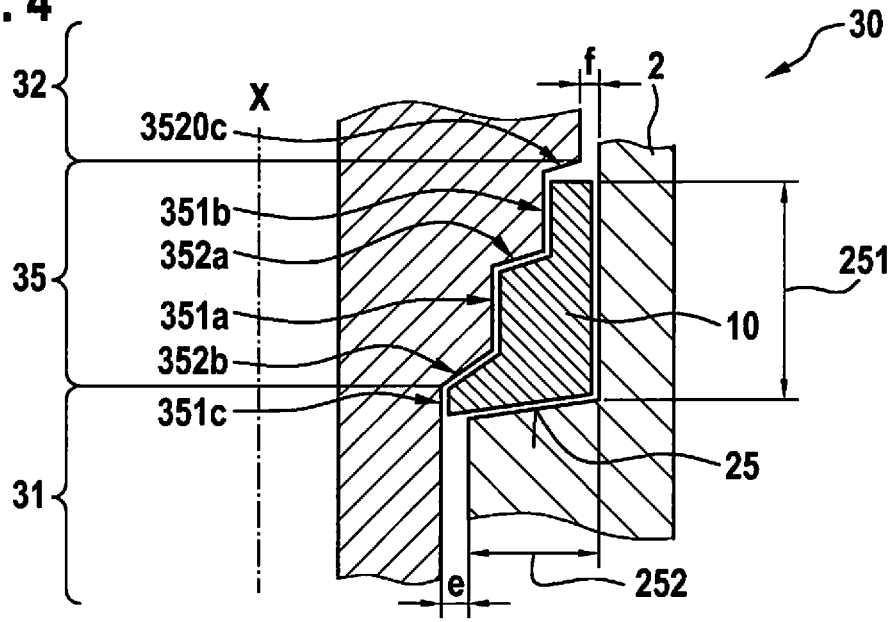
FIG. 4 shows in detail the insulator seat including a step, the inner seal, and the housing seat of the spark plug according to the present invention following the installation.
Figure 5:
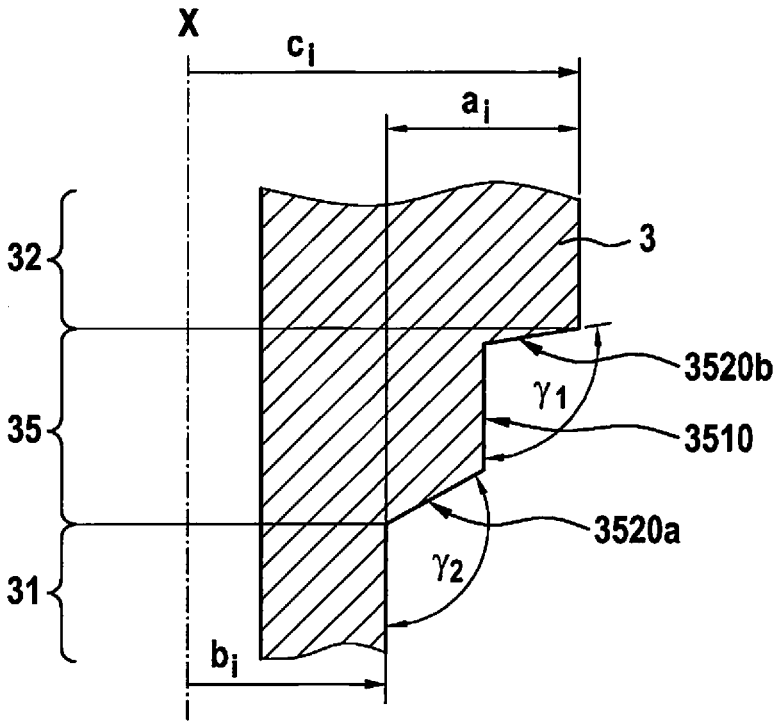
FIG. 5 shows the insulator seat including a step for a spark plug according to the present invention.

FIG. 4 shows in detail area 30 including housing seat 25, insulator seat 35, and inner seal 10 after the installation of insulator 3 into housing 2 according to the present invention. As a result of the installation of insulator 3 into housing 2, a force acts on inner seal 10, whereby inner seal 10 is deformed and radial sealing surfaces 251, 351*a*, 351*b*, 351*c* and axial sealing surfaces 252, 352*a*, 352*b*, 352*c* are formed on insulator 3 and on insulator seat 35 as well as on housing 2 and on housing seat 25. Radial sealing surfaces 351*a*, 351*b* are always formed between inner seal 10 and the surfaces of insulator 3 or housing 2 that are parallel to insulator longitudinal axis X. In the sense of this application, surfaces are also contemplated as being parallel that have a minor inclination, i.e., an angle smaller than 10°, with regard to the longitudinal axis of the spark plugs or to insulator longitudinal axis X.

A radial sealing surface 251 is formed on housing 2 and an axial sealing surface 252 is formed on housing seat 25.

In this exemplary embodiment, insulator seat 35 includes two steps and thus two first sections 3510*a*, 3510*b* and multiple second sections 3520*a*, 3520*b*, 3520*c*. Radial sealing surfaces 351*a*, 351*b* are formed at first sections 3510*a*, 3510*b*. In this case, a radial main sealing surface 351*a* is formed at first section 3510*a* and a radial ancillary sealing surface 351*b* is formed at other first section 3510*b*. Typically, one main sealing surface and multiple ancillary sealing surfaces are formed, the main sealing surface being enclosed by adjacent ancillary sealing surfaces. The main sealing surface is typically the largest area. In addition to the radial sealing surfaces, axial sealing surfaces 352*a*, 352*b* are also formed on the insulator seat at second sections 3520*a*, 3520*b*. In the case of axial sealing surfaces 352*a*, 352*b*, it may be differentiated again between the main sealing surface and the ancillary sealing surfaces.

As a result of the step-like shape of the insulator seat, radial and axial sealing surfaces alternate.

It is not excluded that radial sealing surfaces are also formed on insulator foot 31 or insulator body 32, such as radial sealing surface 351*c* on insulator foot 31.

It is not necessary that a sealing surface is formed at all sections of a step on insulator seat 35. As is shown in this example, it is not a problem if no sealing surface is formed at a section 3520*c* situated at the edge of insulator seat 35.

Axial ancillary sealing surface 352*b*, which abuts insulator foot 31, should be wider than gap width e between insulator foot 31 and housing 2, i.e., below insulator seat 35, and/or wider than gap width f between insulator body 32 and housing 2, i.e., above insulator seat 35.

FIG. 5 shows once again in detail insulator seat 35 including two steps. Insulator longitudinal axis X is visible. The two steps at insulator seat 35 have a different angle γ between their first and second sections 3510, 3520*a*, 3520*b*. Angle γ has a value of 90° to 175°. Depth $a_i$ of insulator seat 35 results from the half difference of diameter $b_i$ at insulator foot 31 and diameter $c_i$ at insulator body 32.

Figure 6:
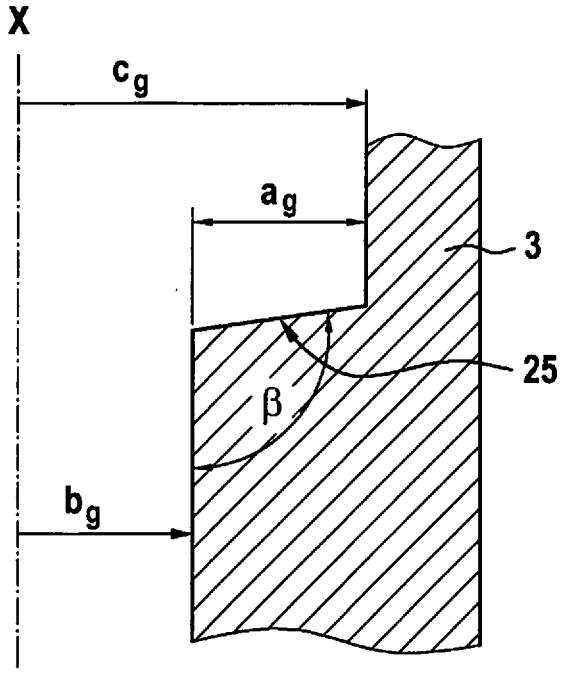
FIG. 6 shows one example of a housing seat for a spark plug according to the present invention.

In FIG. 6, housing seat 25 is shown in detail. Depth $a_g$ of housing seat 25 results from the half difference of the inner diameter of the housing at the height of the insulator foot and of the housing inner diameter $c_g$ above housing seat 25. The diameters are measured perpendicular to the housing longitudinal axis. Housing seat 25 is inclined at an angle ß with regard to the housing longitudinal axis. ß has a value of 90° to 160°. In principle, ß may also have values smaller than 90°, however this makes the manufacturing process more difficult and the manufacturing costs higher.

What is claimed is:

1. A spark plug, comprising:

a housing;

an insulator situated within the housing, the insulator having a longitudinal axis, and including an insulator foot, an insulator body, and an insulator head, and an insulator seat which forms a transition from the insulator foot to the insulator body;

a center electrode situated within the insulator; and a ground electrode situated at a front side of the housing facing a combustion chamber, the ground electrode and the center electrode being situated in such a way that the two electrodes form an ignition gap at a bottom of the spark plug;

wherein:

the housing has on its inside a housing seat which is in contact with the insulator seat of the insulator, an inner seal being situated between the housing seat and the insulator seat, so that the inner seal, the housing seat, and the insulator seat, form a sealing system;

the insulator seat includes at least one step that has a first section and at least one second section, the first section and the second sections having an angle γ to one another that is greater than 0° and the first section being parallel to the insulator longitudinal axis, the inner seal being in contact with the first section, so that a radial sealing surface is formed at the insulator; and at least one of the following four features (I)-(IV):

(I) (a) the at least one step includes at least two steps, the at least one second section including two second sections between which the first section extends, (b) the housing seat is a step formed by a transition, in a first axial region of the spark plug, from a single first inner housing surface to a single second inner housing surface that is arranged at a non-zero and non-straight angle relative to the first inner housing surface, (c) the inner seal, within the first axial region of the spark plug, contacts the at least two second sections and is arranged between (i) the first section and the at least two second sections of the insulator seat and (ii) the single first inner housing surface and the single second inner housing surface of the housing seat, and (d) the housing does not include, within the first axial region, any step other than the step formed by the transition from the single first inner housing surface to the single second inner housing surface;

(II) the spark plug further comprises a resistor and the inner seal is arranged entirely below the resistor;

(III) the spark plug further comprises an outer sealing element and the inner seal is arranged entirely below the outer sealing element; and (IV) the spark plug further comprises a thread by which the spark plug can be screwed into an internal combustion engine, and the inner seal is arranged entirely within an axial region of the spark plug that the thread occupies.

2. The spark plug as recited in claim 1, wherein the at least two steps at the insulator seat, beside the radial sealing surface, additionally has at least two axial sealing surfaces formed at the at least two second sections of the step.

3. The spark plug as recited in claim 2, wherein the radial sealing surface is situated between two axial sealing surfaces.

4. The spark plug as recited in claim 1, wherein the at least two steps forms multiple radial sealing surfaces together with the inner seal.

5. The spark plug as recited in claim 4, wherein the multiple radial sealing surfaces are each connected by axial sealing surfaces.

6. The spark plug as recited in claim 5, wherein there is one radial main sealing surface including at least one radial ancillary sealing surface and/or there is one axial main sealing surface including at least one axial ancillary sealing surface at the insulator seat.

7. The spark plug as recited in claim 1, wherein the second sections of the steps at the insulator seat include an angle of 90° to 175° with regard to the insulator longitudinal axis.

8. The spark plug as recited in claim 7, wherein all second sections of the steps include the same angle with regard to the insulator longitudinal axis.

9. The spark plug as recited in claim 1, wherein the housing seat spans an angle with regard to the insulator longitudinal axis having a value of at least 80° and maximally 170°.

10. The spark plug as recited in claim 9, wherein the value is between 90° and 160°.

11. The spark plug as recited in claim 1, wherein prior to installation, the inner seal on average has a height h, measured in parallel to the insulator longitudinal axis, and a width d, measured perpendicular to the insulator longitudinal axis, and the inner seal has a ratio of width d to height h of at least 0.5, prior to the installation.

12. The spark plug as recited in claim 11, wherein the ratio is at least 0.75, prior to the installation.

13. The spark plug as recited in claim 1, wherein prior to installation, the inner seal on average has a height h, measured in parallel to the insulator longitudinal axis, and a width d, measured perpendicular to the insulator longitudinal axis, and the radial sealing surface at the insulator seat has a height, measured in parallel to the insulator longitudinal axis of at least 30% of the height h of the inner seal.

14. The spark plug as recited in claim 13, wherein the radial sealing surface at the insulator seat has the height, measured in parallel to the insulator longitudinal axis of at least 36% of the height h of the inner seal.

15. The spark plug as recited in claim 6, wherein prior to installation, the inner seal on average has a height h, measured in parallel to the insulator longitudinal axis, and a width d, measured perpendicular to the insulator longitudinal axis, and the radial main sealing surface at the insulator seat has a height, measured in parallel to the insulator longitudinal axis, of at least 30% of the height h of the inner seal.

16. The spark plug as recited in claim 15, wherein the radial main sealing surface at the insulator seat has the height, measured in parallel to the insulator longitudinal axis, or at least 36% of the height h of the inner seal.

17. The spark plug as recited in claim 4, wherein prior to installation, the inner seal on average has a height h, measured in parallel to the insulator longitudinal axis, and a width d, measured perpendicular to the insulator longitudinal axis, and the radial ancillary sealing surfaces at the insulator seat have a height, measured in parallel to the insulator longitudinal axis, of at least 1% of the height h of the inner seal.

18. The spark plug as recited in claim 4, wherein prior to installation, the inner seal on average has a height h, measured in parallel to the insulator longitudinal axis, and a width d, measured perpendicular to the insulator longitudinal axis, and the radial ancillary sealing surfaces at the insulator seat have a height, measured in parallel to the insulator longitudinal axis, of at least 5% of the height h of the inner seal.

19. The spark plug as recited in claim 1, wherein prior to installation, the inner seal on average has a height h, measured in parallel to the insulator longitudinal axis, and a width d, measured perpendicular to the insulator longitudinal axis, and the inner seal and the housing form an axial sealing surface at the housing seat and a radial sealing surface on the inside of the housing, the radial sealing surface at the housing having a height, measured in parallel to the insulator longitudinal axis, of at least 30% of the height h of the inner seal.

20. The spark plug as recited in claim 1, wherein prior to installation, the inner seal on average has a height h, measured in parallel to the insulator longitudinal axis, and a width d, measured perpendicular to the insulator longitudinal axis, and the inner seal and the housing form an axial sealing surface at the housing seat and a radial sealing surface on the inside of the housing, the radial sealing surface at the housing having a height, measured in parallel to the insulator longitudinal axis, of at least 36% of the height h of the inner seal.

21. The spark plug as recited in claim 1, wherein prior to installation, the inner seal on average has a height h, measured in parallel to the insulator longitudinal axis, and a width d, measured perpendicular to the insulator longitudinal axis, and the axial sealing surface at the insulator seat has a width, measured perpendicular to the insulator longitudinal axis, of at least 15% of the width d of the inner seal.

22. The spark plug as recited in claim 1, wherein prior to installation, the inner seal on average has a height h, measured in parallel to the insulator longitudinal axis, and a width d, measured perpendicular to the insulator longitudinal axis, and the axial sealing surface at the insulator seat has a width, measured perpendicular to the insulator longitudinal axis, of at least 20% of the width d of the inner seal.

23. The spark plug as recited in claim 6, wherein prior to installation, the inner seal on average has a height h, measured in parallel to the insulator longitudinal axis, and a width d, measured perpendicular to the insulator longitudinal axis, and the axial main sealing surface at the insulator seat has a width, measured perpendicular to the insulator longitudinal axis, of at least 15% of the width d of the inner seal.

24. The spark plug as recited in claim 6, wherein prior to installation, the inner seal on average has a height h, measured in parallel to the insulator longitudinal axis, and a width d, measured perpendicular to the insulator longitudinal axis, and the axial main sealing surface at the insulator seat has a width, measured perpendicular to the insulator longitudinal axis, of at least 20% of the width d of the inner seal.

25. The spark plug as recited in claim 4, wherein prior to installation, the inner seal on average has a height h, measured in parallel to the insulator longitudinal axis, and a width d, measured perpendicular to the insulator longitudinal axis, and the axial ancillary sealing surfaces at the insulator seat have a width, measured perpendicularly to the insulator longitudinal axis, of at least 1% of the width d of the inner seal.

26. The spark plug as recited in claim 4, wherein prior to installation, the inner seal on average has a height h, measured in parallel to the insulator longitudinal axis, and a width d, measured perpendicular to the insulator longitudinal axis, and the axial ancillary sealing surfaces at the insulator seat have a width, measured perpendicularly to the insulator longitudinal axis, of at least 5% of the width d of the inner seal.

27. The spark plug as recited in claim 2, wherein the axial sealing surface at the insulator seat, which directly adjoins the insulator foot, has at least a width that corresponds to a narrowest gap width between the insulator foot and the inside of the housing opposite the insulator foot.

28. The spark plug as recited in claim 1, wherein:

(a) the at least one step includes at least two steps, the at least one second section including the two second sections between which the first section extends;

(b) the housing seat is the step formed by the transition, in the first axial region of the spark plug, from the single first inner housing surface to the single second inner housing surface that is arranged at the non-zero and non-straight angle relative to the first inner housing surface;

(c) the inner seal, within the first axial region of the spark plug, contacts the at least two second sections and is arranged between:

(i) the first section and the at least two second sections of the insulator seat; and (ii) the single first inner housing surface and the single second inner housing surface of the housing seat; and (d) the housing does not include, within the first axial region, any step other than the step formed by the transition from the single first inner housing surface to the single second inner housing surface.

29. The spark plug as recited in claim 1, wherein the spark plug further comprises the resistor and the inner seal is arranged entirely below the resistor.

30. The spark plug as recited in claim 1, wherein the spark plug further comprises the outer sealing element and the inner seal is arranged entirely below the outer sealing element.

31. The spark plug as recited in claim 1, wherein the spark plug further comprises the thread by which the spark plug can be screwed into the internal combustion engine, and the inner seal is arranged entirely within the axial region of the spark plug that the thread occupies.

32. A spark plug, comprising:

a housing;

an insulator situated within the housing, the insulator having a longitudinal axis, and including an insulator foot, an insulator body above the insulator foot, and an insulator head above the insulator body, and an insulator seat which forms a transition from the insulator foot to the insulator body;

a center electrode situated within the insulator; and a ground electrode situated at a front side of the housing facing a combustion chamber, the ground electrode and the center electrode being situated in such a way that the two electrodes form an ignition gap at a bottom of the spark plug;

wherein:

the housing has on its inside a housing seat corresponding and facing opposite to the insulator seat of the insulator, an inner seal being situated between the housing seat and the insulator seat, so that the inner seal, the housing seat, and the insulator seat, form a sealing system;

the insulator seat includes a step that has a first section and a second section above the first section;

the first section and the second section have an angle $\gamma$ to each other that is greater than 0°;

the first section is approximately parallel to the insulator longitudinal axis;

the inner seal protrudes from on the second section to on the first section so that the inner seal is in contact with the second section and also the first section, forming a radial sealing surface at the insulator foot; and at least one of the following two features (I) and (II):

(I) the spark plug further comprises a resistor, and the first and second sections are both entirely below the resistor; and (II) the second section is a bottom-most radial widening section of the insulator that forms the step to connect a pair of adjacent sections of the insulator, including the first section, a diameter of the insulator differing between the pair of adjacent sections.

* * * * *